US007938076B2

(12) United States Patent
Ulgen

(10) Patent No.: US 7,938,076 B2
(45) Date of Patent: May 10, 2011

(54) KEEL MECHANISM FOR SAILBOATS

(76) Inventor: Mehmet Nevres Ulgen, Istanbul (TR)

( * ) Notice: Subject to any disclaimer, the term of this patent is extended or adjusted under 35 U.S.C. 154(b) by 0 days.

(21) Appl. No.: 12/268,633

(22) Filed: Nov. 11, 2008

(65) Prior Publication Data

US 2010/0116188 A1 May 13, 2010

(51) Int. Cl.
*B63B 41/00* (2006.01)

(52) U.S. Cl. ..... 114/143; 114/124

(58) Field of Classification Search ..... 114/121, 114/124, 125, 126, 140, 141, 143, 149, 122, 114/39.21, 39.26
See application file for complete search history.

(56) References Cited

U.S. PATENT DOCUMENTS

| | | | | | |
|---|---|---|---|---|---|
| 648,911 | A * | 5/1900 | Beardsley | 114/143 |
| 700,011 | A * | 5/1902 | Becker | 114/143 |
| 3,903,827 | A * | 9/1975 | Marcil | 114/143 |
| 4,817,550 | A * | 4/1989 | Gutsche | 114/143 |
| 5,163,377 | A * | 11/1992 | Calderon et al. | 114/143 |
| 5,280,760 | A * | 1/1994 | Edwards | 114/143 |
| 5,860,381 | A * | 1/1999 | Fernandini | 114/140 |
| 5,967,074 | A * | 10/1999 | Frantl et al. | 114/143 |
| 6,382,121 | B2 * | 5/2002 | Yu | 114/141 |
| 6,951,180 | B2 * | 10/2005 | Robinson et al. | 114/143 |

* cited by examiner

*Primary Examiner* — Lars A Olson
(74) *Attorney, Agent, or Firm* — Vidas, Arrett & Steinkraus

(57) ABSTRACT

A keel (1) mechanism for a sailboat (10), wherein the keel (1) comprises a drive mechanism for moving the keel (1) linearly along the axis (x) extending from the fore end to rear end of the sailboat (10), and swinging the keel around the axis (x) extending from the fore end to rear end of the sailboat (10), and swinging the keel around the axis extending from larboard to starboard of the sailboat in response to conditions taking place.

6 Claims, 7 Drawing Sheets

KEEL MECHANISM FOR SAILBOATS

FIELD OF INVENTION

The present invention relates to a mechanism for sailboats, which provides the driving or moving of the keel, in three-dimensional space, extending downwards from the boat's underwater hull in response to certain conditions, particularly when forces exerted on the sail in various directions due to wind.

BACKGROUND OF INVENTION

Since the energy required for driving sailboats in water is afforded from the wind, the geometrical form and size of the a sail which confronts the wind force become very crucial with respect to the sailing capability of the boat. On the other hand, the stable floating of the sailboat on the water depending on the wind force is directly related to the location of the boat's center of gravity.

The wind exerting throughout the sail's surface area generates force and this force produces a moment so that the boat is forced to tip to various directions as a result of this moment. As a matter of fact, if no balancing effect is provided, the risk occurs in which such a boat may assume a position that would sink it into the water under the effect of this moment. The balancing of many sailboats against external moments is ensured by means of keels provided at the underwater hull of such boats.

Keels of the type in the art are mounted to the hull in a fixed manner, i.e. statically. A static keel may cause the boat to loose its stability against varying wind loads effecting the sails and worsening the boat's tipping angle, finally preventing the boat from moving fast as desired.

DISCLOSURE OF INVENTION

The object of the present invention is to achieve more stable and speedier sailboats, by providing the opportunity of changing the boat's center of gravity dynamically in response to the direction and strength of the wind hitting to sail of the sailboat.

In order to achieve this object, the present invention provides a sailboat keel, the keel comprising a drive mechanism in order to move linearly along the fore to rear end axis of the boat in response to conditions taking place.

In a preferred embodiment of the present invention, said drive mechanism comprises a shaft to which the keel is coupled via arms, and the shaft has plurality of threads of an endless screw.

The keel mechanism according to the invention further comprises drive means that enables the keel to swing around an axis extending from fore end to rear end of the sailboat and to swing around an axis extending from larboard to starboard of the sailboat.

BRIEF DESCRIPTION OF FIGURES

The present invention is to be evaluated together with annexed figures briefly described hereunder to make clear the subject embodiment and the advantages thereof.

REFERENCE NUMBERS OF PARTS IN FIGURES

1 Keel
2 Threaded shaft
3 Arm
4 Threaded arm-coupling element
5 Pin
6 Channeled rotating tube
7 Piston
8 Casing
9 Channel
10 Boat

DETAILED DESCRIPTION OF INVENTION

Figure 1:
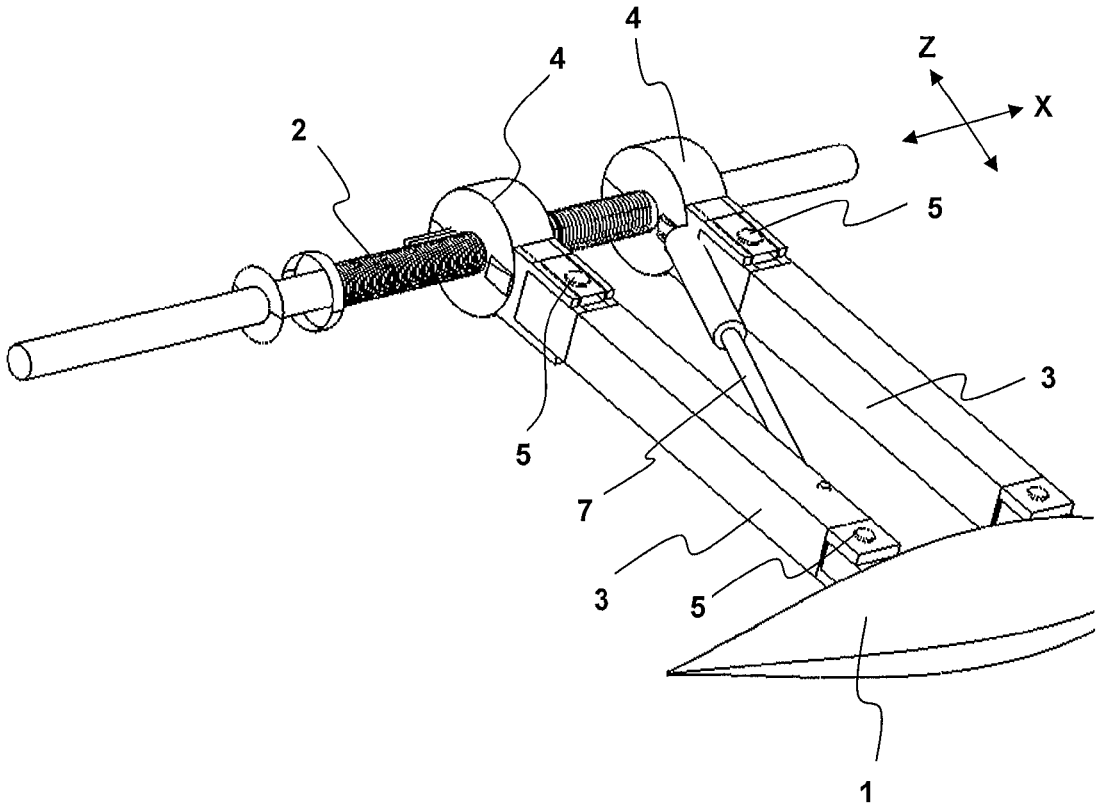
FIG. 1 is a perspective view of the mechanism enabling the keel according to the present invention to move linearly along the axis extending from fore end to rear end of the sailboat.

As illustrated in FIG. 1, the keel (1) is coupled to a threaded shaft (2) by means of arms (3) and of threaded arm-coupling elements (4) connected with these arms (3). Said threaded shaft (2) comprises an endless screw, and the threads formed on the inner surface of the arm coupling elements (4), which (i.e. inner surface) is positioned on the threaded shaft (2), are designed so as to cooperate with the threads of the threaded shaft. As the threaded shaft is rotated the keel (1) moves linearly along the axis (x) extending from the fore end to rear end of the sailboat.

Figure 2:
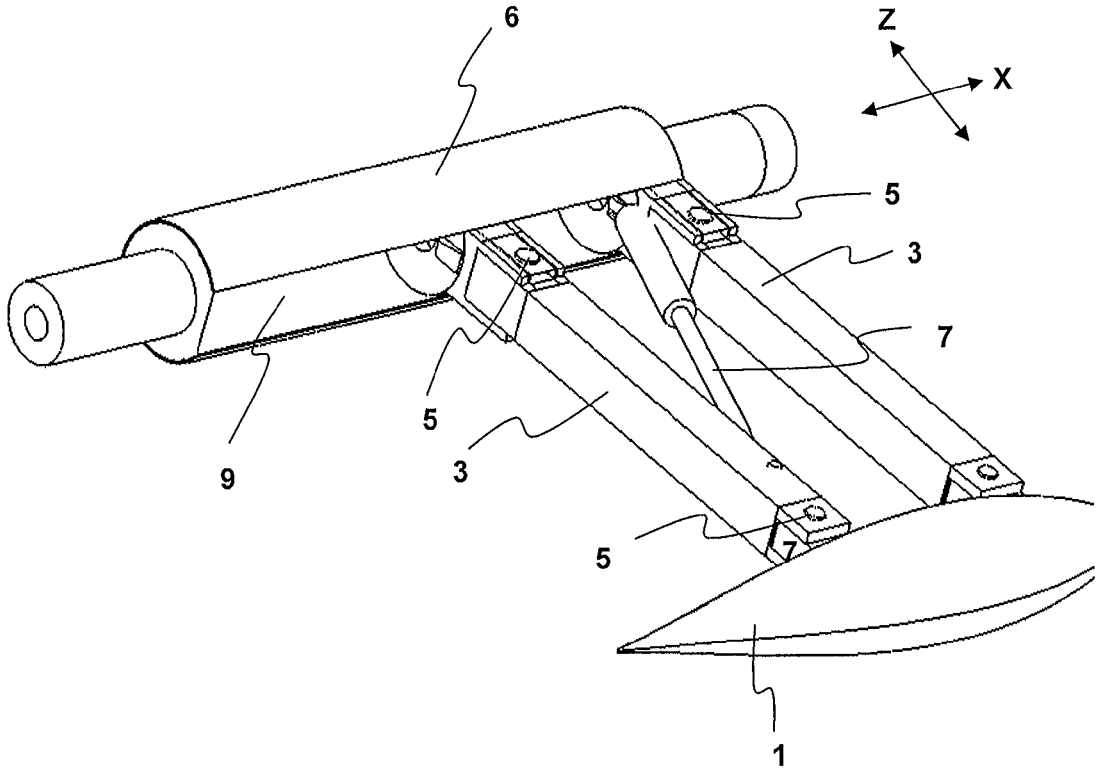
FIG. 2 is a perspective view of the mechanism enabling the keel according to the present invention to swing around the axis extending from fore end to rear end of the sailboat.

Pins (5) are provided between the arms (3) and the threaded arm-coupling elements (4) in order to swing the arms (3) around the axis (y) extending from larboard to starboard of the sailboat. Similarly, other pins (5) are provided between the arms (5) and the keel connection for rotating the arms (3) relative to the keel (1). The drive required for swinging the keel (1) around the axis (y) extending from larboard to starboard of the sailboat is provided by means of a piston (7) the ends of which are connected to said arms (3). The position of piston as illustrated in FIG. 2 corresponds to the case in which the piston (7) is open at maximum, i.e. the keel (1) is at the lower most position. As a result of gradually starting to close the piston (7), the arms (3) start rotating around the pins (5) so as to lift the keel upwards.

When the threaded shaft (2), which is positioned along the axis extending form the fore end to rear end of the sailboat (10) is rotated at one direction (e.g. clockwise direction), the threaded arm-coupling elements (4) and the keel (1) in connection with said elements displace forward (or rearward) in a direction extending from the fore end to the rear end of the sailboat, and when the shaft (2) is rotated in the counter wise direction (e.g. counterclockwise direction), it is displaced in the rearward (or forward) direction.

Figure 3:
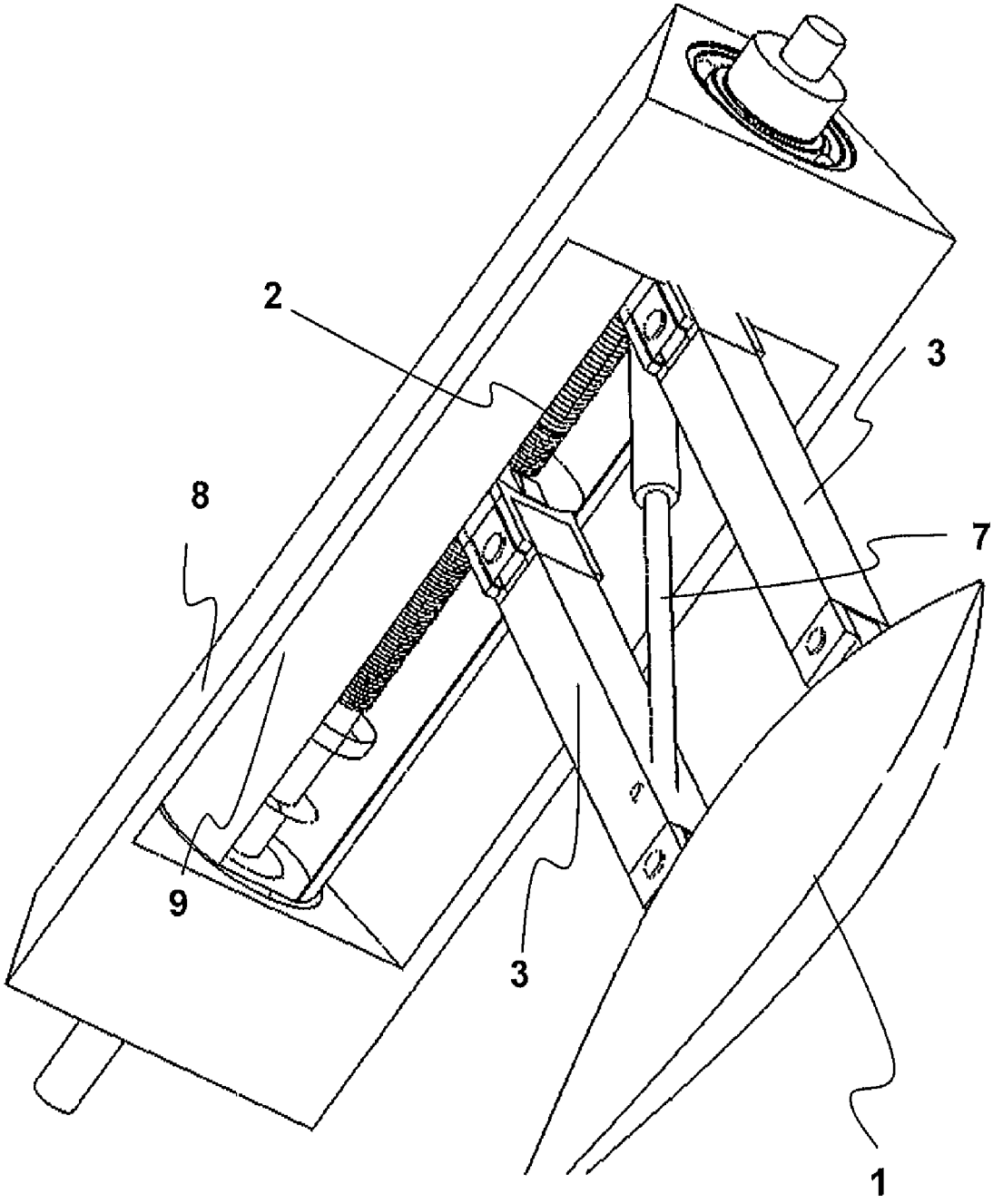
FIG. 3 is a perspective view of the keel according to the present invention as viewed from below of the boat.

FIG. 3 is a perspective view of the mechanism enabling the keel (1) according to the present invention to swing around the axis (x) extending from the fore end to rear end of the sailboat. Accordingly, a channeled rotating tube (6) is provided so as to accommodate said threaded shaft (2). When it is desired to swing the keel (1) around the axis (x) extending from the fore end to the rear end of the sailboat (10), the channeled rotating tube (6) is driven around its own axis, and since the longitudinal edges of the channel (9) of the rotating tube (6) are leaned against the threaded arm-coupling elements (4), the channeled rotating tube (6) in the rotating position rotates these threaded arm-coupling elements (4) together and consequently, the arms (3) and keel (1) are rotated together around the threaded shaft's (2) axis.

Figure 4:
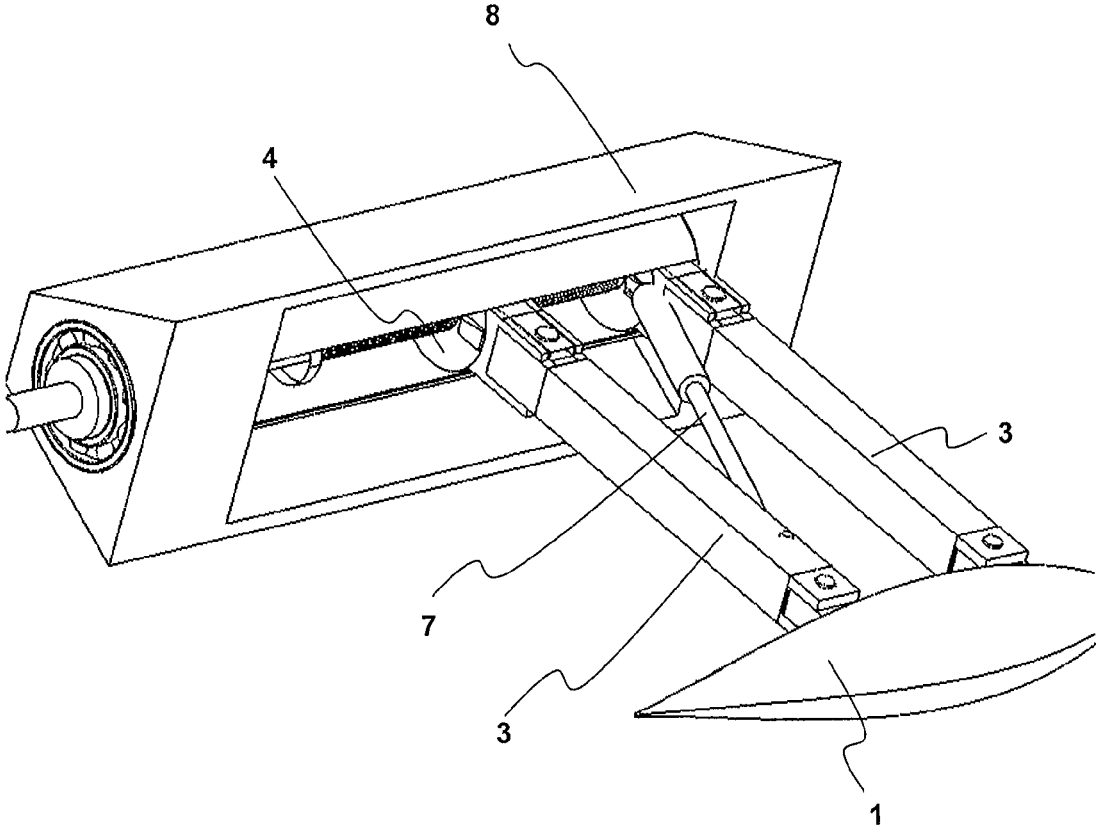
FIG. 4 is a perspective view of the keel according to the present invention as viewed from below of the sailboat.
Figures 5A, 5B:
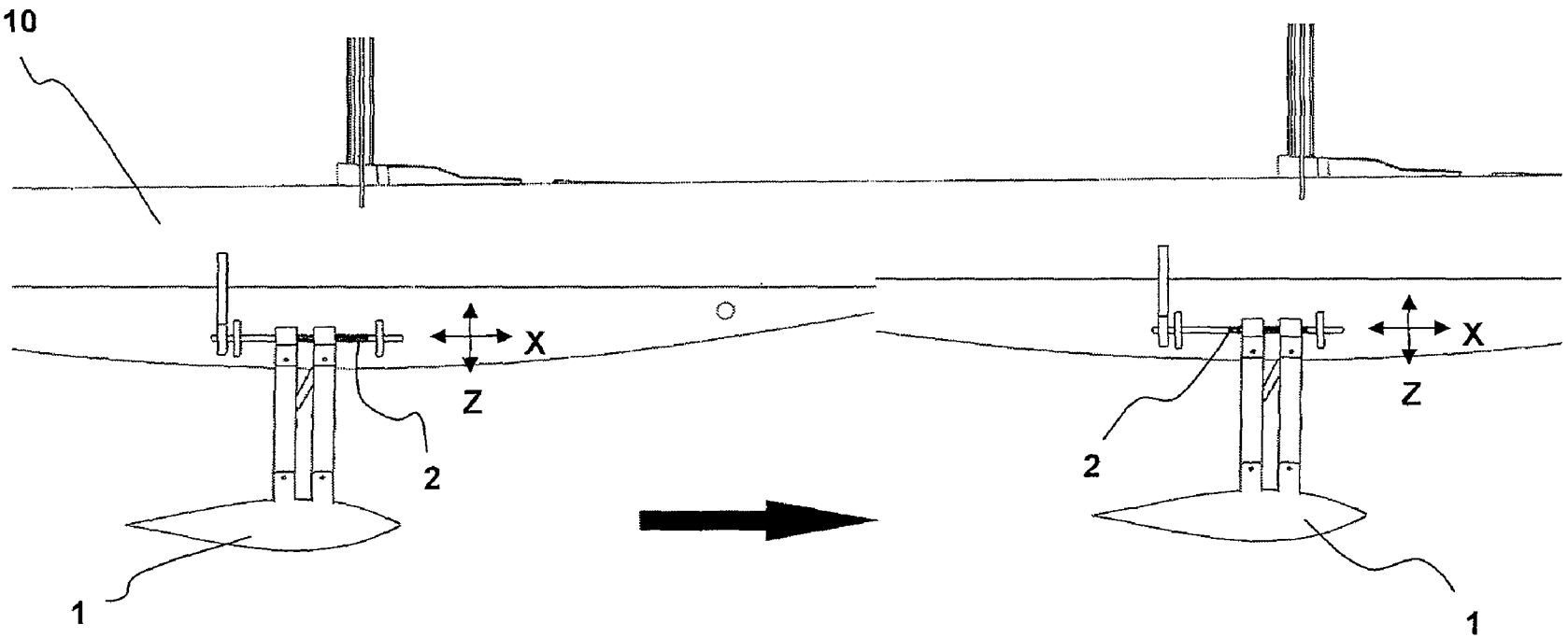
FIG. 5*a* is a side view of the first position of said mechanism that enables the keel to move linearly along the axis extending from fore end to rear end of the sailboat.
FIG. 5*b* is a side view of a second position of the keel illustrated in FIG. 5*a*.
Figure 6C:
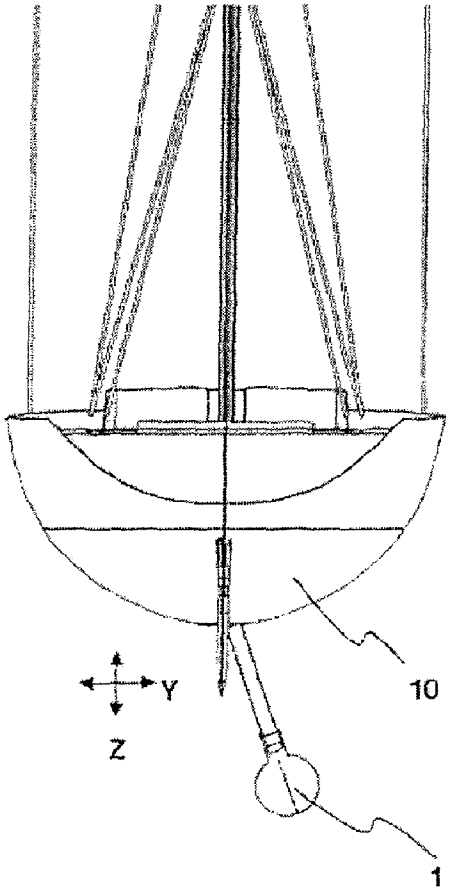
FIG. 6*c* is an illustration in which the keel shown in FIG. 6*a* is now positioned at the right part.
Figure 6B:
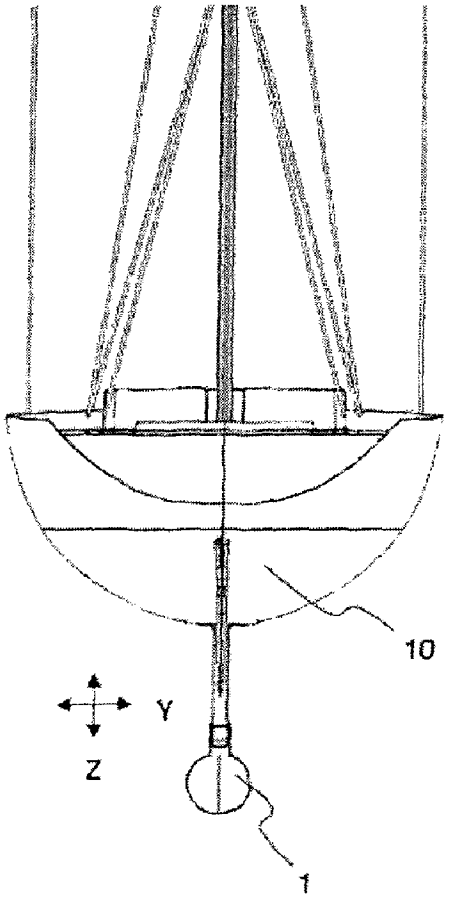
FIG. 6*b* is an illustration in which the keel shown in FIG. 6*a* is now positioned at the central part.
Figure 6A:
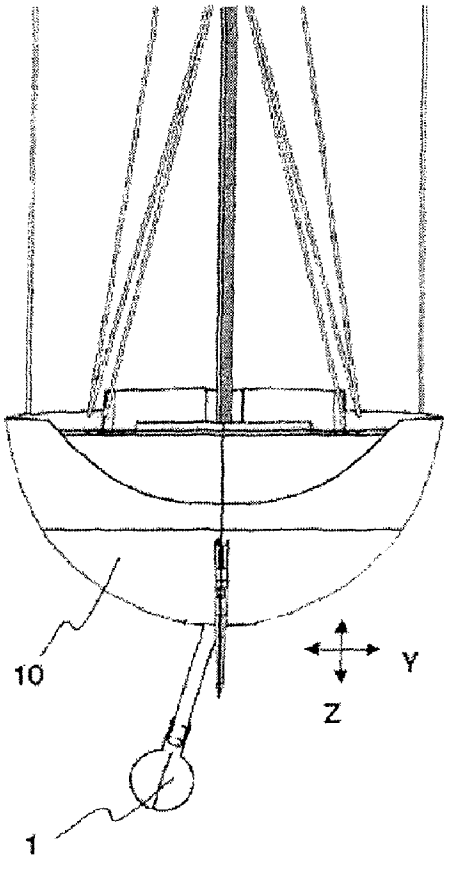
FIG. 6*a* is an illustration in which the mechanism enabling the keel to swing around the axis extending from fore end to rear end of the sailboat is positioned at the left side.
Figure 7B:
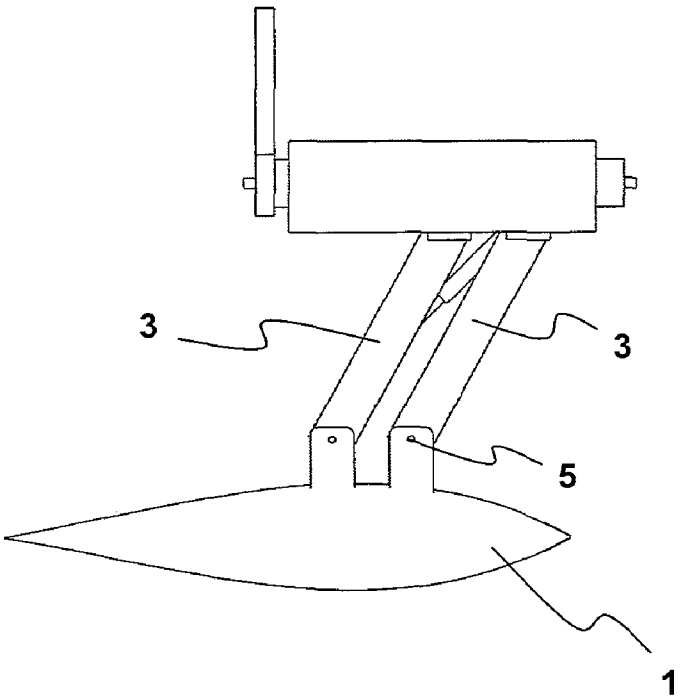
FIG. 7*b* is a side view of a second position of the keel illustrated in FIG. 7*a*.
Figure 7A:
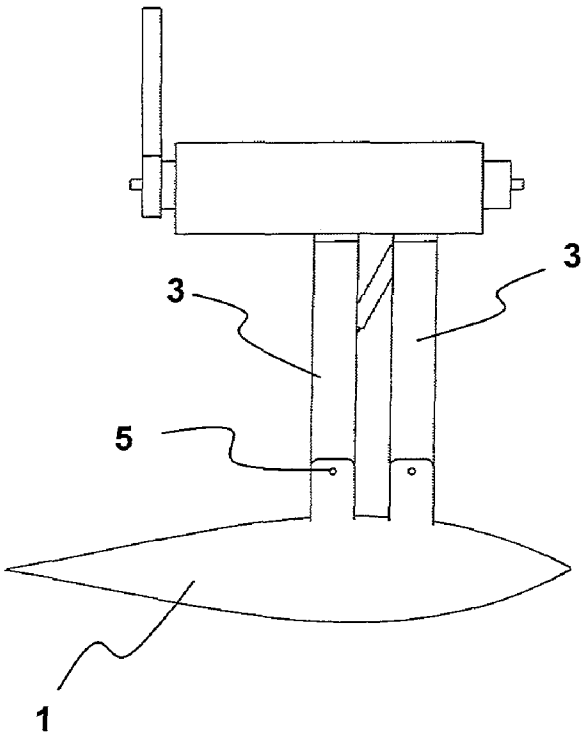
FIG. 7*a* is a side view of the first position of said mechanism enabling the keel to swing around the axis extending from larboard to starboard of the sailboat.

As illustrated in FIGS. 3 and 4, the threaded shaft (2) and the channeled rotating tube (6) are placed into a casing (8), provided at the underwater hull and having preferably a prismatic formation.

The invention claimed is:

1. A keel (1) mechanism for a sailboat (10), wherein the keel (1) comprises a drive mechanism for moving the keel (1) linearly along the axis (x) extending from the fore end to rear end of the sailboat (10), and swinging the keel around the axis (x) extending from the fore end to rear end of the sailboat (10), and swinging the keel around the axis extending from larboard to starboard of the sailboat in response to conditions taking place, wherein the drive mechanism moving the keel (1) linearly along the axis (x) extending from the fore end to rear end of the sailboat (10) comprises a threaded shaft (2) capable of rotating around of its axis, at least one threaded arm-coupling element (4) that can be positioned on said threaded shaft and cooperating with the threads of the threaded shaft, and at least one arm (3) one end of which is connected to the at least one threaded arm-coupling element (4) and to the keel (1) from the other end.

2. A keel mechanism according to claim 1, further comprising pins (5) provided at the connection point of said arms (3) with said threaded arm-coupling elements (4) and at the connection point of said arms (3) with the keel (1).

3. A keel (1) mechanism for a sailboat (10), wherein the keel (1) comprises a drive mechanism for moving the keel (1) linearly along the axis (x) extending from the fore end to rear end of the sailboat (10), and swinging the keel around the axis (x) extending from the fore end to rear end of the sailboat (10), and swinging the keel around the axis extending from larboard to starboard of the sailboat in response to conditions taking place, wherein the drive mechanism swinging the keel along the axis (x) extending from the fore end to rear end of the sailboat (10) comprises a threaded shaft (2), at least one threaded arm-coupling element (4) that can be positioned on said threaded shaft (2), at least one arm (3) one end of which is coupled to the at least one threaded arm-coupling element (4) and to the keel (1) from the other end, and a channeled rotating tube (6) positioned so as to accommodate said threaded shaft (2) therein.

4. A keel mechanism according to claim 3, wherein the channeled rotating tube (6) comprises a channel (9) opened along the longitudinal axis of the tube (6).

5. A keel (1) mechanism for a sailboat (10), wherein the keel (1) comprises a drive mechanism for moving the keel (1) linearly along the axis (x) extending from the fore end to rear end of the sailboat (10), and swinging the keel around the axis (x) extending from the fore end to rear end of the sailboat (10), and swinging the keel around the axis extending from larboard to starboard of the sailboat in response to conditions taking place, wherein the drive mechanism swinging the keel around the axis extending from larboard to starboard of the sailboat comprises a threaded shaft (2), at least one threaded arm-coupling element (4) positioned on said threaded shaft (2), at least one arm (3), one end of which is coupled to the at least one threaded arm-coupling element (4) and to the keel (1) from the other end, and at least one piston (7) connected to the arms (3).

6. A keel mechanism according to claim 5, wherein pins (5) are provided at the connection point of said arms (3) with said threaded arm-coupling elements (4) and at the connection point of said arms (3) with the keel (1).

* * * * *